US007302946B1

(12) United States Patent
Harding

(10) Patent No.: US 7,302,946 B1
(45) Date of Patent: Dec. 4, 2007

(54) INDUSTRIAL SCARIFIER ASSEMBLY

(75) Inventor: William R. Harding, Middletown, MD (US)

(73) Assignee: Equipment Development Company, Inc., Frederick, MD (US)

( * ) Notice: Subject to any disclaimer, the term of this patent is extended or adjusted under 35 U.S.C. 154(b) by 115 days.

(21) Appl. No.: 11/221,854

(22) Filed: Sep. 9, 2005

(51) Int. Cl.
*B28D 1/18* (2006.01)
*B24D 11/00* (2006.01)

(52) U.S. Cl. ..... 125/3; 51/209; 451/529

(58) Field of Classification Search ..... 125/3, 125/37; 51/209; 229/40.1; 451/529, 353; 217/124, 77, 40, 3 FC
See application file for complete search history.

(56) References Cited

U.S. PATENT DOCUMENTS 3,460,633 A * 8/1969 Richey et al. ..... 172/691
3,486,274 A * 12/1969 David ..... 451/290
D275,617 S * 9/1984 Pichelman et al. ..... D32/25
4,486,931 A * 12/1984 Pichelman et al. ..... 29/81.05
4,702,223 A * 10/1987 Swan ..... 125/3
5,586,930 A * 12/1996 Hayashi et al. ..... 451/548

* cited by examiner

*Primary Examiner*—Alvin J. Grant
(74) *Attorney, Agent, or Firm*—Michael W. York

(57) ABSTRACT

A scarifier assembly including a generally rectangular shaped case with a hollow interior, a resilient generally rectangular pad located in the hollow interior of the case, and a removable work performing surface insert having work surfaces for grinding, cutting or abrading materials. The work performing surface insert includes a generally rectangular shaped flat mounting plate member having two oppositely located end portions with connected projecting securing means for removably securing the work performing surface insert in the case. The case also has two end portions and these end portions that have securing means for cooperating with the projecting securing means on the end portions of the mounting plate member for securing the work performing surface insert to the case. The mounting plate member has an upper surface and a lower surface with a series of elongated mounting blocks having work performing surfaces firmly secured to the upper surface.

10 Claims, 2 Drawing Sheets

INDUSTRIAL SCARIFIER ASSEMBLY

BACKGROUND OF THE INVENTION

This invention relates to improvements to industrial scarifier assemblies particularly of the type set forth in U.S. Pat. No. 4,702,223. The industrial scarifier assembly set forth in U.S. Pat. No. 4,702,223 generally performs in an excellent manner and has proven itself to perform very well for a number of years. However, it has become apparent that there are several portions in the industrial scarifier assembly that are in need of improvement. First, it has become apparent that the surfaces that perform the grinding or cutting or abrading of the current industrial scarifier assemblies do not wear in a uniform manner. While this is a typical occurrence with such industrial scarifiers, this has two basic adverse effects. First, this means that the portions of the industrial scarifier assembly with these grinding or cutting or abrading surfaces must be replaced while there is still usable working surface area available on the scarifier assembly. This is wasteful as well as creating an unnecessary expense for an unused surface. In addition, this means that the portion of the industrial scarifier assembly that holds the elements with the grinding, cutting or abrading surfaces must be replaced more frequently than would be the case if the grinding, cutting or abrading surface wore evenly or if the scarifier assembly portion with such surfaces could be reversed to compensate for such uneven wear. In this connection, due to the construction of the current industrial scarifier assembly set forth in U.S. Pat. No. 4,702,223 it is not possible to reverse the portion of the industrial scarifier assembly having the elements with the grinding, cutting, or abrading surfaces. In addition to these problems, the portion of the previous industrial scarifier assembly set forth in U.S. Pat. No. 4,702,223 that holds the elements with the grinding, cutting or abrading surfaces is not positively secured in place and consequently, it has come loose at times which has had the adverse effect of requiring stopping the use of the machine using the industrial scarifier assembly and reseating the portion of the industrial scarifier assembly that has the elements with the grinding, cutting or abrading surfaces.

These problems connected with the industrial scarifier assembly set forth in U.S. Pat. No. 4,702,223 have been eliminated with this improved industrial scarifier assembly. With this improved industrial scarifier assembly, the portion of the industrial scarifier assembly that holds the grinding, cutting or abrading surfaces is reversible so that it can be reversed after uneven wear occurs on the grinding, cutting or abrading surfaces to correct for this uneven wear. This corrects the previous loss of usable grinding, cutting or abrading surface that occurred with the previous industrial surfacer or scarifier assemblies due to uneven wear of the grinding, cutting or abrading working surfaces. This, of course, results in a cost savings and extends the time that portion of the improved industrial scarifier assembly with the grinding, cutting or abrading can be used before it is replaced with a new one.

The unlatching problem that occurred with the previous industrial surfacer or scarifier assemblies has also been eliminated with this improved industrial scarifier assembly. With this improved industrial surfacer or scarifier assembly, it is essentially impossible for the portion of the scarifier assembly with the grinding, cutting or abrading surface to become unintentionally separated from the rest of the improved industrial scarifier assembly due to the positive manner in which the portion of the scarifier assembly with the grinding, cutting or abrading surfaces is locked to the rest of the improved industrial scarifier assembly when the improved industrial scarifier assembly is being utilized.

SUMMARY OF THE INVENTION

This invention relates to industrial surfacers or scarifiers and more particularly to an improved scarifier assembly with a replaceable work performing surface insert assembly.

Accordingly, it is an object of the invention to provide a scarifier assembly with improvements that provide increased performance over past scarifier assemblies.

It is an object of the invention to provide a scarifier assembly that is less likely to malfunction than previous scarifier assemblies.

It is an object of the invention to provide a scarifier assembly that connects the problem of having unused grinding, cutting or abrading surface that was present in previous scarifier assemblies.

It is an object of the invention to provide a scarifier assembly in which the scarifier assembly has a removable working surface portion that is reversible so that all of the working surface is utilized.

It is an object of the present invention to provide a scarifier assembly with a removable working surface portion that requires less frequent replacement due to wear on its working surfaces than previous scarifier assemblies.

It is an object of the present invention to provide a scarifier assembly with a removable working surface portion that cannot come lose in the case as was possible with previous scarifier assemblies.

It is an object of the present invention to provide a scarifier assembly with a removable working surface portion that is capable of being locked to the rest of the scarifier assembly.

It is an object of the present invention to provide a scarifier assembly with a removable working surface portion in which the removable working surface portion is easy to reverse.

It is an object of the invention to provide a scarifier assembly that is easier to use than past scarifier assemblies.

It is an object of the invention to provide a scarifier assembly with a removable working surface portion in which the removable working surface portion is easy to replace.

It is an object of the invention to provide a scarifier assembly that costs less to operate than previous scarifier assemblies.

It is an object of the invention to provide a scarifier assembly which is easy to manufacture.

It is an object of the invention to provide a scarifier assembly which is easy to repair.

These and other objects of the invention will become apparent from the following description of the invention that includes a scarifier assembly including a generally rectangular shaped case with a hollow interior, resilient means comprising a resilient generally rectangular pad sized and shaped to be located in the hollow interior of the case, and work performing surface insert means for providing the scarifier assembly with a removable and replaceable work performing surface for performing work such as grinding, cutting or abrading on a surface such as concrete that is being worked on. The work performing surface insert means comprises a generally rectangular shaped flat mounting plate member that is sized and shaped and adapted to be removably inserted into the interior of the case and to be located adjacent to the generally rectangular pad. The mounting plate member has two oppositely located end portions with projecting securing means for securing the work performing surface insert means to the case. The case also has two end portions and these end portions also have securing means for cooperating with the projecting securing means on the end portions of the mounting plate member for securing the work performing surface insert means to the case. The mounting plate has an outer surface and a inner surface with a series of elongated rectangular shaped mounting blocks having work performing surfaces firmly secured to the outer surface of the mounting plate member. The mounting plate member also has two spaced apart generally rectangular shaped positioning bars for positioning the mounting plate member in the case. The projecting securing means comprises a generally rectangular shaped securing member with a projecting rounded end portion that is firmly secured to the underside of each end portion of the mounting plate member. The case has two oppositely located end walls. One of the end walls has an elongated slot located through it and the other end wall has an elongated hole through it. The end of the case that has the end wall with the elongated hole or aperture has a generally rectangular shaped lip portion located over the opening to the case and the end wall with the slot located in it has a generally rectangular shaped spring clip member that has an aperture that is sized and shaped to receive the securing member so that the spring clip member holds the securing member in place. The two securing members are identical so that the work performing surface insert means is reversible. The case has two oppositely located side walls with two notches on the upper edges of the side walls that are sized and shaped to receive portions of the positioning bars on the mounting plate member.

BRIEF DESCRIPTION OF THE DRAWINGS

The invention will be hereinafter more completely described with reference to the accompanying drawings in which.

DETAILED DESCRIPTION OF THE PREFERRED EMBODIMENT

As used herein the words "work performing surface" means the surface that performs such operations as grinding, cutting, abrading, polishing or the like upon the surface such as a concrete floor or some other surface that is to be or is being worked upon. Such a work performing surface would include, but not be limited to, a diamond impregnated surface.

Figure 1:
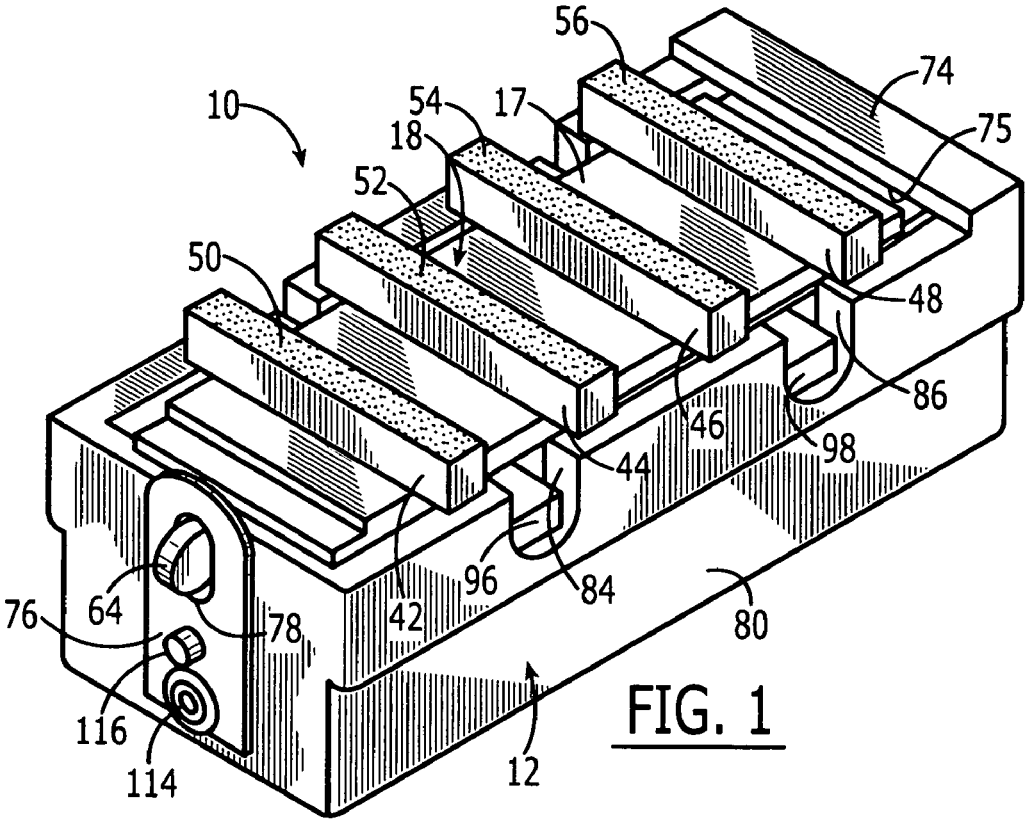
FIG. 1 is a perspective view of the assembled scarifier assembly invention.
Figure 2:
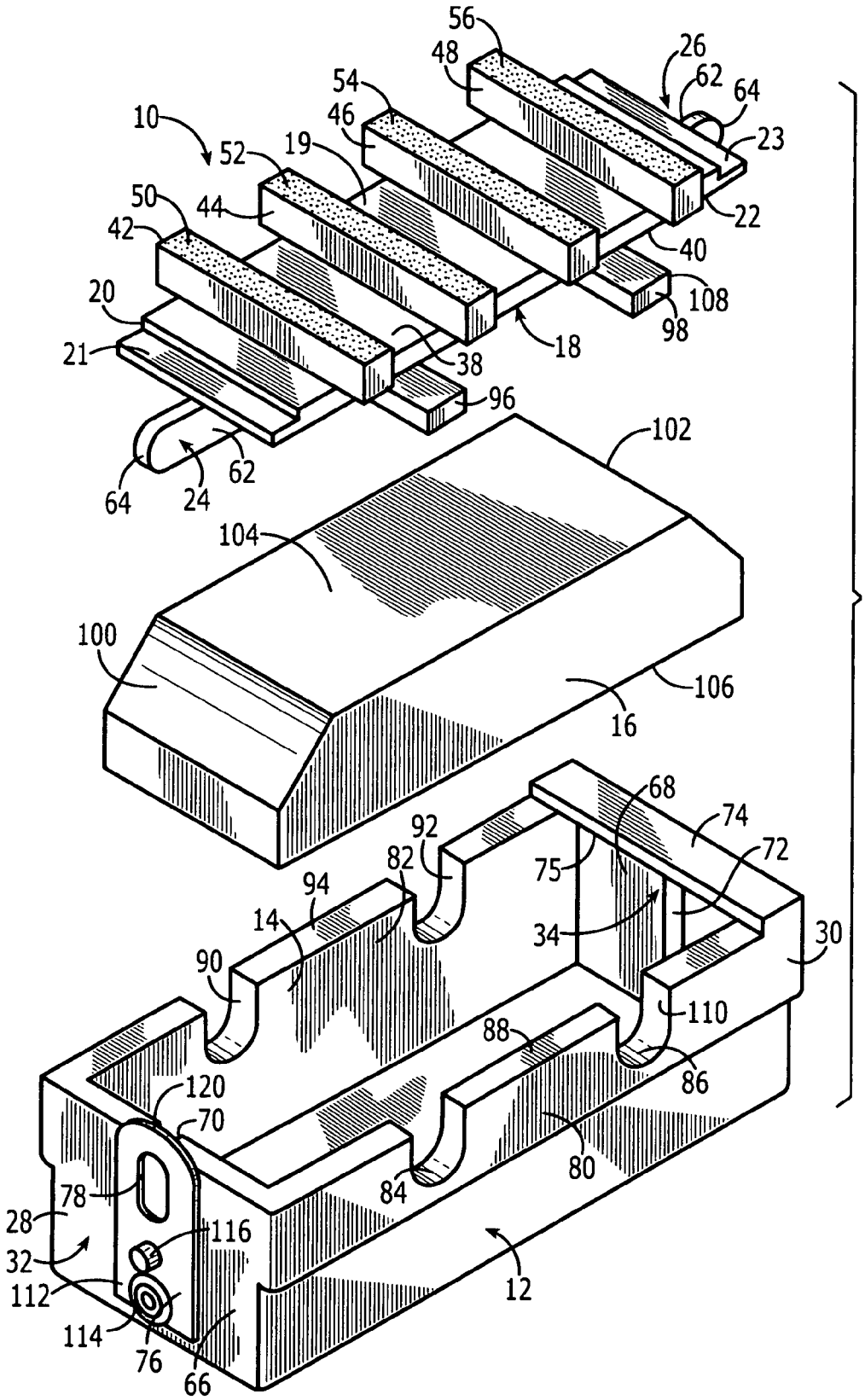
FIG. 2 is an exploded view of the scarifier assembly invention set forth in FIG. 1.

Referring first to FIGS. 1 and 2, the scarifier assembly invention is illustrated and is designated generally by the number 10. The scarifier assembly 10 comprises a generally rectangular shaped case 12 with a hollow interior 14, resilient means for providing a compression cushion material comprising a resilient generally rectangular shaped pad 16 sized and shaped to be located in the hollow interior 14 of the case 12 and work performing surface insert means 18 for providing the scarifier assembly 10 with a removable and replaceable work performing surface. The work performing surface insert means 18 comprises a generally rectangular shaped flat mounting plate member 19 that is sized, shaped and adapted to be removable inserted into the hollow interior 14 of the case 12 and be located adjacent to the generally rectangular resilient pad 16. The mounting plate member 19 of the work performing surface insert means 18 has two oppositely located end portions 20 and 22 with connected projecting securing means 24 and 26 for securing the mounting plate member 19 and the work performing surface insert means 18 to the case 12. The mounting plate member 19 also has identical depressed surfaces 21 and 22 on the outer edges of the respective end portions 20 and 22 for assisting in securing the mounting plate member 19 to the case 12. The case 12 also has two end portions 28 and 30 and these end portions 28 and 30 also have respective securing means 32 and 34 for cooperating with the projecting securing means 24 and 26 on the end portions 20 and 22 of the work performing surface insert means 18 for securing the work performing surface insert means 18 within the case 12. The mounting plate member 19 has an outer surface 38 and an inner surface 40 with a series of spaced apart elongated substantially identical rectangular shaped mounting blocks 42, 44, 46, and 48 firmly secured to the outer surface 38 of the mounting plate member 19.

In the preferred embodiment, the mounting blocks 42, 44, 46, and 48 have respective outward facing diamond impregnated cutting surfaces 50, 52, 54, and 56. The mounting plate member 19 also has two spaced apart generally rectangular shaped positioning bars 58 and 60 for positioning the mounting plate member 19 in the case 12. The projecting securing means 24 and 26 are identical and each securing means 24 and 26 includes a generally rectangular shaped securing member 62 with a projecting rounded end portion 64 and a securing member 62 is firmly secured to the underside 40 of each end portion 20 and 22 of the mounting plate member 19.

The case 12 has two oppositely located end walls 66 and 68. One of the end walls 66 has an elongated slot 70 located through it and the other end wall 68 has an elongated hole 72 extending through it. The end of the case 12 that has the end wall 68 with the elongated hole 72 has a generally rectangular shaped lip portion 74 located over the opening 14 of the case 12 and the end wall 66 with the slot 70 located in it has a generally rectangular shaped spring clip member 76 with an aperture 78 that is sized and shaped to receive the securing member 62 so that the spring clip member 76 holds the securing member 62 securely in place. As indicated previously, the end portions of the mounting plate member 19 have substantially identical depressed surfaces 21 and 23 that are sized and shaped to be secured under the under surface 75 of the lip portion 74 of the case 12. This permits either end portion 20 or 22 with the depressed surface 21 or 23 to be readily slipped under the lip portion 74 and secured by the lip portion 74. The two securing members 62 are substantially identical so that the work performing surface insert means 18 is reversible in the case 12 since either end portion 20 or 22 with the depressed surface 21 or 23 can also be readily slipped under the under surface 75 of the lip portion 74 and secured by the lip portion 74.

The case 12 has two oppositely located side walls 80 and 82. The side wall 80 has two notches or depressions 84 and 86 in its outer edge 88 and the other side wall 82 has two notches or depressions 90 and 92 in its outer edge 94. The notches 84, 86, 90 and 92 are substantially identical and they are sized and shaped to receive portions of two substantially identical elongated generally rectangular shaped positioning bars 96 and 98 that are secured to the underside 40 of the mounting plate member 19.

There are some aspects of portions of the components of the scarifier assembly invention 10 that are important for the proper functioning of the scarifier assembly 10. In this connection, it should be noted in FIG. 3 that the two opposite end corner portions 100 and 102 of the resilient pad 16 are substantially flat and form surfaces that are substantially at 45 degree angles with the upper and lower flat surfaces 104 and 106 of the resilient pad 16. It has unexpectedly been determined that these 45 degree surfaces assist in the proper insertion of the work performing surface insert means 18 into the case 12.

Figure 3:
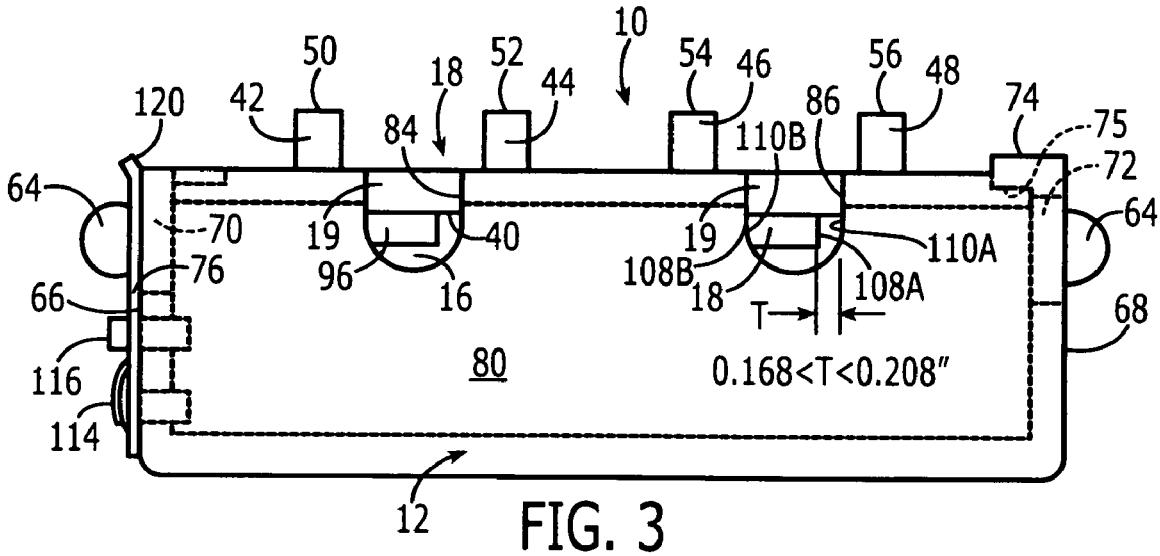
FIG. 3 is a side elevational view of the assembled scarifier assembly invention set forth in FIG. 1.

As illustrated in FIG. 3, it should be noted that the side walls 110A and 110B of the notch 86 are substantially flat and substantially parallel and the adjacent portion of the positioning bar has substantially flat and substantially parallel sides 108A and 108B located to face and be substantially parallel with the respective substantially flat and substantially parallel side walls 110A and 110B of the notch 86 when the adjacent portion of the positioning bar 98 is seated in position in the notch 86. Also, as illustrated in FIG. 3, it should be noted that there is a deliberate tolerance between the sides 108A and 108B of the positioning bar 98 and the adjacent side walls 110A and 110B of the notch 86. This deliberate tolerance is represented by the letter T and in the preferred embodiment of the scarifier assembly invention it has been determined that T should be within the limits 0.168"<T<0.208". This tolerance T also applies to the substantially identical notches 84, 90 and 92 and the associated portions of the respective positioning bars 96 and 98. It should be noted that for convenience of illustration the positioning bar 98 is illustrated being moved to one side in the notch 86 so that the wall 108B of the positioning bar 98 is up against the side wall 110B of the notch 86. This has the advantage of forming only one gap for representing the tolerence T that is easy to present in a drawing. However, if the positioning bar was located away from the side wall 110B, there would be two gaps, but you would obviously have the same tolerence T that would be the sum of the widths of the gaps.

It is also important to note that the clip member 76 is only secured to the case 12 below the slot 70 at its lower end portion 112 by a rivet 114 or the like. It should also be noted that an orienting projection 116 extends outward from the end wall 66 of the case 12 below the slot 70 and passes through an aperture 118 in the clip member 76 that is located below the elongated hole 78 in the clip member 76. It should also be noted that the upper portion 120 of the clip member 76 that extends outward from the opening 14 to the case 12 is rounded and bent outward slightly. This permits the rounded end portion 64 of the securing member 62 to readily push the clip member 76 outward when the work performing surface insert means 18 is inserted into the open hollow interior 14 of the case 12.

The scarifier assembly invention 10 is used in the following manner. The case 12 is used with powered disc grinders for refinishing surfaces such as concrete surfaces in a manner similar to that for the invention set forth in the previously mentioned U.S. Pat. No. 3,179,103 and hence this aspect of the scarifier assembly invention 10 is well known in the art and will not be described. In normal use, the resilient pad 16 is already installed in the interior 14 of the case 12 and if it is not then it would be installed with the inclined surfaces 160 and 162 facing out of the case 12.

In order to use the scarifier assembly 10, the work performing surface insert means 18 is inserted into the case 12. This is accomplished by pushing one of the rounded end portions 64 of the securing member 62 under the lip portion 74 of the case 12 and into the elongated aperture 72 in the end wall 68 of the case 12 and at the same time, one of the depressed surfaces 21 or 23 of the mounting plate member 19 is pressed or slipped under the under surface 75 of the lip portion 74 of the case 12. Also, as this is being accomplished, the end portions of the positioning bars 96 and 98 are located over the respective notches or indentations 84 and 90 and 86 and 92 and then the work performing surface insert means 18 is pushed or rotated toward and into the open interior 14 of the case 12 so that the outer end portions of the positioning bars 96 and 98 are inserted and seated in the indentations 84 and 90 and 86 and 92 in the walls 80 and 82 of the case 12.

As this occurs, the other rounded end portion 64 of the other securing member 62 contacts the rounded and outwardly bent portion 120 of the clip member 76 causing the non-secured portion of the clip member 76 to spring away from the end wall 66 of the case 12. Further downward pressure on the work performing surface insert means 18, results in the rounded end portion 64 of the clip member 62 entering the aperture 78 in the clip member 76. When this occurs, the work performing surface insert means 18 is securely connected to the case 12 since a portion of one securing member 62 is restrained in the aperture 78 of the clip member 76 and the other securing member 62 is restrained in the elongated aperture 72 in the end wall 68 of the case 12. Furthermore, lateral movement of the work performing surface insert means 18 is restricted by the portions of the positioning bars 96 and 98 that are located in the respective notches or indentations 84 and 90 and 86 and 92.

The work performing surface insert means 18 and the associated case 12 are then ready to be used and they are placed in use in a normal manner in a manner that is well known to those skilled in the art. With use, the working surfaces 50, 52, 54, and 56 of the mounting blocks 42, 44, 46 and 48 will become worn in an uneven manner. When this occurs, the user or operator pulls outward on the outer free portion 120 of the clip member 76 and this frees the associated securing member 62 from the clip member 76 and the case 12. Then, the work performing surface insert means 18 is removed from the case 12 and is rotated 180 degrees so that the location of the securing members 62 is reversed and then the work performing surface insert means 18 is reinserted into the interior 14 of the case 12 in the previously described manner. The net result of this reversal is to present different portions of the working surfaces 50, 52, 54 and 56 to the surface that is being worked on so that effective cutting, grinding, or abrading of that surface can still occur. This extends the useful life of the work performing surface insert means 18 beyond the life that was obtained with previous assemblies.

The scarifier assembly 10 is made for standard materials known in the art using suitable casting, cutting and machining techniques known in the art. The case 12 is made from a suitable grade of aluminum by known techniques and the various surfaces are suitable machined where necessary. In a similar manner, the resilient pad 14 is formed from recycled rubber using rubber forming techniques known in the art. The various components of the work performing surface insert means 18 with the exception of the mounting blocks 42, 44, 46 and 48 are made from a suitable grade of hot rolled steel using suitable machining and heat treating techniques and they are assembled using conventional welding techniques known in the art. The mounting blocks 42, 44, 46 and 48 are conventional and are secured to the mounting plate member 19 by known silver soldering techniques.

Although the invention has been described in considerable detail with reference to a certain preferred embodiment, it will be understood that variations or modifications may be made within the spirit and scope of the invention as defined in the appended claims.

What is claimed is:

1. A scarifier assembly comprising a generally rectangular shaped case with a hollow interior, a resilient generally rectangular pad located in the hollow interior of the case, and removable work performing surface insert means comprising a generally rectangular shaped flat mounting plate member having work surfaces adapted to be located within the hollow interior of the case, the mounting plate member having an upper surface with a plurality of mounting members with each mounting member having a work performing surface secured to the upper surface of the mounting plate member and the mounting plate member having two oppositely located end portions with connected substantially identical projecting securing means for securing the work performing surface insert means to the case.

2. The scarifier assembly of claim 1 wherein the case has two end portions and the end portions have securing means for cooperating with the projecting securing means on the end portions of the mounting plate member for securing the work performing surface insert means to the case.

3. The scarifier assembly of claim 2 wherein the mounting plate member is adapted to be reversed when the mounting plate member is inserted into the interior of the case.

4. The scarifier assembly of claim 3 wherein one of the securing means on the end portions of the case for cooperating with the projecting securing means on the end portions of the mounting plate member comprises a lip portion on one end portion of the case.

5. The scarifier assembly of claim 4 wherein one of the securing means on the end portions of the case for cooperating with the projecting securing means on the end portions of the mounting plate member comprises a spring clip member.

6. The scarifier assembly of claim 5 wherein the securing means on the end portions of the case for cooperating with the projecting securing means on the end portions of the mounting plate member also comprises an opening through the end wall of the case sized and shaped to receive the projecting securing means on the end portions of the mounting plate member.

7. The scarifier assembly of claim 6 wherein the case has two side wall portions with at least one notch located in each side wall portion and the mounting plate member has a lower surface with at least one positioning member located on the lower surface having portions thereof sized and shaped to be located in the notch located in each side wall portion of the case.

8. The scarifier assembly of claim 7 wherein the at least one positioning member comprises a positioning bar.

9. The scarifier assembly of claim 8 wherein the notches have substantially parallel and substantially flat side walls and the positioning bar has a portion thereof with substantially parallel and substantially flat sides located to face the substantially parallel and substantially flat side walls of the notch when the positioning bar portion is seated in position in the notch.

10. The scarifier assembly of claim 9 wherein there is a deliberate tolerance T between the substantially parallel and substantially flat side walls of the notch and the substantially parallel and substantially flat sides of the portion of the positioning bar when the positioning bar is seated in position in the notch and this tolerance T is between following limits:

$$0.168'' < T < 0.208''.$$

* * * * *